US009551545B1

(12) United States Patent
Rowe

(10) Patent No.: US 9,551,545 B1
(45) Date of Patent: Jan. 24, 2017

(54) PIVOT AXIS PIN FIXTURES FOR RIFLE RECEIVERS

(71) Applicant: Jeffrey J. Rowe, Collegeville, PA (US)

(72) Inventor: Jeffrey J. Rowe, Collegeville, PA (US)

( * ) Notice: Subject to any disclaimer, the term of this patent is extended or adjusted under 35 U.S.C. 154(b) by 0 days.

(21) Appl. No.: 14/465,200

(22) Filed: Aug. 21, 2014

Related U.S. Application Data

(63) Continuation-in-part of application No. 14/271,802, filed on May 7, 2014, now abandoned.

(60) Provisional application No. 61/846,781, filed on Jul. 16, 2013, provisional application No. 61/855,064, filed on May 7, 2013.

(51) Int. Cl.
*F41A 19/06* (2006.01)

(52) U.S. Cl.
CPC ..... *F41A 19/06* (2013.01)

(58) Field of Classification Search
CPC ..... F41A 19/06; F41A 19/10; F41A 17/72; F41A 17/56; F41A 17/46; F41A 17/02; F41A 17/00; F41A 17/30; F41A 17/82; F41A 19/14; Y10T 74/20762; F24B 5/025; F24B 5/26; F24B 12/54; F24B 5/08; F24B 7/02
USPC ..... 42/0.02, 0.03, 70.08, 65
See application file for complete search history.

(56) References Cited

U.S. PATENT DOCUMENTS 1,539,826 A 6/1925 Boutelle ..... 351/99
1,934,731 A * 11/1933 Nahm ..... F42C 7/12 137/551
2,292,557 A 8/1942 Wilson ..... 470/59
2,465,271 A * 3/1949 Ruau ..... F41A 5/32 89/136
2,543,444 A * 2/1951 Dezorze ..... B25B 23/0057 81/124.1
2,547,789 A 4/1951 Skeel ..... 403/370
2,990,218 A 6/1961 Schlechtendahl ..... 384/430
3,319,209 A 5/1967 Reyenga ..... 338/162
3,741,205 A 6/1973 Markolf et al. ..... 128/92 B
3,841,774 A 10/1974 Maxey ..... 403/358
4,187,767 A 2/1980 Jones, Jr. et al. ..... 92/171
4,372,703 A 2/1983 Szostak ..... 403/324
4,728,202 A 3/1988 LaRou ..... 384/537
5,536,127 A 7/1996 Pennig ..... 411/413
5,815,973 A * 10/1998 Hochstrate ..... F41A 19/14 42/65
6,669,396 B2 12/2003 Mattle ..... 403/294
(Continued)

FOREIGN PATENT DOCUMENTS

DE 957092 1/1957

*Primary Examiner* — Troy Chambers
*Assistant Examiner* — Bridget Cochran
(74) *Attorney, Agent, or Firm* — Jonathan A. Bay

(57) ABSTRACT

A pivot-axis, pin arrangement for rifle receivers can serve as a trigger or hammer pin therefor. A lower housing has a pair of sidewalls defining a gap and with a pair of bores spaced across the gap. The outer side of one sidewall has a slightly recessed channel which is elongated between spaced ends, at least one of which is rounded and centered on the axes of the spaced bores. The pivot axis pin has a cylindrical shaft and a T-slot head style head. The head has one portion forming an annular ring while the remaining portion is elongated to an end. In use, the pin is inserted through the bores, and is 'simply supported' by the ends thereof in the bores therefor. The head of the pin locks against rotation merely by settling in into at least one rounded end of the recessed channel.

2 Claims, 11 Drawing Sheets

(56) References Cited

U.S. PATENT DOCUMENTS

| | | | | |
|---|---|---|---|---|
| 8,464,455 | B2 * | 6/2013 | Kallio | F41A 17/02 42/70.06 |
| 8,510,980 | B2 * | 8/2013 | Lee | F41A 19/10 42/69.01 |
| 8,819,978 | B2 * | 9/2014 | Lee | F41A 19/10 42/69.01 |
| 2012/0023801 | A1 * | 2/2012 | Rozum | F41A 17/00 42/70.08 |
| 2015/0068090 | A1 * | 3/2015 | Christensen | F41A 17/82 42/69.01 |

* cited by examiner

PIVOT AXIS PIN FIXTURES FOR RIFLE RECEIVERS

CROSS-REFERENCE TO RELATED APPLICATION(S)

This application is a continuation-in-part of U.S. patent application Ser. No. 14/271,802, filed May 7, 2014, which claims the benefit of U.S. Provisional Application No. 61/855,064, filed May 7, 2013, and, U.S. Provisional Application No. 61/846,781, filed Jul. 16, 2013, the foregoing disclosures thereof are hereby incorporated herein by this reference thereto.

BACKGROUND OF THE INVENTION

The invention relates to rifle receivers and, more particularly, to improvements in pivot axis pin fixtures therein. Additionally, the invention relates to a threaded assembly pin and, more particularly, to replacement of conventional roll pins for assembly of not only the bolt catch mechanism of an AR-15 firearm but also the forward assist mechanism.

The improvements of invention were inspired in particular with improving the design(s) of AR-15 lower housings, and like style of firearms. Nowadays, the features of AR-15 lower housings are typically machined from aluminum castings. After the machining operations, certain accessories are mounted to the aluminum lower housing as a subsequent assembly operation.

For example, various pivoting parts are mounted to the aluminum lower housing by means of pivot axis pins typically produced from steel, and then mounted in bores therefor bored into the receiver. Such pivoting parts include without limitation the hammer and trigger (which are mounted on laterally extending pins), the forward assist mechanism, or else bolt stop release mechanism and the like (which are typically mounted on longitudinally extending pins).

The hammer and trigger for an AR-15 lower housing are typically mounted on pins which are not intended to rotate. Hence the pins are intended to be fixtures. The hammer and trigger are mounted to pivot on these fixed pins.

The pins are preferably mounted as follows. That is, the pins typically have smooth cylindrical walls. The pins are mounted in the manner of being 'simply supported' at their opposite ends in spaced bores therefor in the spaced left and right sidewalls of the lower housing (or spaced port and starboard sidewalls thereof). This way, the pins span across a hollow interior of the lower housing in which is laterally confined the hammer and trigger for each respective pin. Preferably each pin is slid through one of the bores therefor in one sidewall of the lower housing (preferably a bore that provides a close fit). Then the pin is slid through a counterpart bore therefor in the respective hammer or trigger. Finally the pin is preferably press fitted into the opposite bore therefor in the spaced sidewall of the lower housing, wherein this bore is slightly undersized to force an interference fit.

In this manner, the pins are intended to be fixtures for the hammer and trigger to pivot thereon. However, after many cycles of firing and re-loading, the pins are vibrated to such an extent that the pins start to work loose in their close fits and/or press fits. The pins might also seize in the mounting bores therefor in the hammer and/or trigger.

That is, the hammer and trigger as well as the pins therefor are typically steel parts (eg., hard materials) which tend to seize (eg., the hammer or trigger with its respective pin) if there is any problem at the cylindrical interface therebetween. In other words, if there are any problems between the hammer and trigger and each one's respective pin, relative pivoting will likely be eliminated due to seizure. Such sources of problems leading to seizure include any of wear, distortion, corrosion, erosion, and so on.

The housing, typically being made of a softer material, typically suffers. If the pins were originally tightly held by the housing due to a press fit, but subsequently seize with the hammer of trigger, the pins will thereafter spin in their press fit bores in the housing. Given enough use, the features which mount the pins (or are mounted on the pins) start to distort. The pins may start to rotate during the actuation of the hammer and/or trigger.

The pins and the mounting holes therefor in both sidewalls of the lower housing as well as in the hammer and trigger are designed in accordance with tight tolerances not just for optimal performance but also to avoid ruination to unacceptable performance.

But as mentioned previously, the pins are made of steel while the lower housing is typically made of aluminum. This unfortunately makes the lower housing more susceptible to any damage when things begin to function abnormally. What normally happens is that the pins begin to rotate, slightly at first. This causes the bores to become oversized and/or egg shaped.

As the mounting bores are compromised by enlargement, the lower housing is unable to maintain its positioning tolerance as required by engineering specification therefor. The engineering specification for the function of the hammer and trigger pins is such that the pins are meant to be stable while the hammer and trigger pivot about the pins.

Once this initial deformation occurs, there is an exponential amount of damage caused after each use. In time, dramatic steps need to be taken to amend the damage, and sometimes it renders a lower housing damaged beyond repair.

To turn attention now more particularly to the bolt catch feature of an AR-15 firearm, the conventional way to assemble the bolt catch mechanism has been to use roll pins. That is, the forward assist mechanism would be positioned and locked into place using a roll pin. The roll pin would be typically positioned and driven in place by use of a punch. To disassemble the pin, such a roll pin would have to be driven back out with use of the punch again.

Such hammering back and forth is difficult for a majority of individuals to perform in such delicate circumstances. Moreover, such hammering risks increased chances of damaging the housing if the pin is driven in incorrectly (and also if the punch slips).

The foregoing problems are likely and exacerbated by the small-scale working room afforded to a user attempting to drift punch such rolls pins.

Here is why. The pivot pin for the forward assist mechanism is typically 'simply supported' across gap between a pair of spaced bosses (eg., raised protrusions). These bosses are typically raised on the outer sidewall of the lower housing, just forward of the trigger, and on the side opposite of the user's trigger-pulling hand. Each boss (eg., raised protrusion) will need to have a through hole for the roll pin. That is because, the through hole in one boss allows for insertion of the pin. The through hole in the opposite boss either allows for the roll pin to be pushed through until the pin falls out, or else insertion of the punch to push the pin out in reverse (eg., back out the hole it was inserted through).

There are many many problems with the foregoing. These bosses are just slight protrusions off the sidewall of the housing. The roll pin is intended to be disposed on a pivot axis which just barely clears the plane of the housing sidewall. Therefore, the main problems are with the punch tool. With allegorical reference to children stories, the punch tool can be likened to Gulliver in a Lilliputian work-environment. If the punch tool has a radius larger than the gap between the pivot axis of the roll pin and the housing sidewall, the punch tool cannot drive the roll pin on axis. The punch tool can only do so at an oblique angle. If, to solve that problem, the punch tool is made especially slender (but long), then the chances of driving the pin straight are only likely to the skilled, the lucky, or just the skilled and lucky. And then there is the clearance of features on the sidewall of the of the housing to give a flight path for the punch from both sides of the housings, or, from the side of just one housing but clearance for the pin to push out from the opposite side of the opposite housing.

The problems with the roll pin insertion and removal for the forward assist mechanism according to the prior art are rife. What are needed are solutions over the shortcomings of the prior art.

To be brief about the forward assist mechanism, it enables the AR-15 user to manually drive the bolt carrier forward when the carrier becomes jammed. There is a socket or cavity in the rifle receiver lower housing for the forward assist mechanism to be inserted into. The conventional way for retaining the forward assist mechanism in its socket has been to use a roll pin. The forward assist mechanism could likewise benefit by the replacement of roll pins with a threaded assembly pin.

A number of additional features and objects will be apparent in connection with the following discussion of the preferred embodiments and examples with reference to the drawings.

SUMMARY OF THE INVENTION

It is an object of the invention to provide roll pin replacements rifle receivers.

Such objects and other aspects of the invention are provided by a pivot axis pin arrangements for rifle receivers comprising in whole or in part, and without limitation, the following:— a pair of pivot axis pins, one comprising a trigger pin and the other comprising a hammer pin; and a lower housing having a pair of laterally spaced sidewalls defining a longitudinal cavity providing clearance for the mounting of a trigger;

said lower housing having a first pair of lateral bores laterally-spaced across the longitudinal cavity from each other for mounting said pin;

said lower housing having a second pair of spaced lateral bores laterally-spaced across the longitudinal cavity from each other for mounting the hammer pin;

said sidewalls of the lower housing having outer sides formed with slightly recessed channels;

wherein each recessed channel is elongated between spaced ends, said recessed channels typically run a straight course between the spaced ends, but the spaced ends are rounded, and the rounded ends of the recessed channels are centered on the axes of the first pair of spaced bores and second pair of spaced bores, respectively;

each pivot axis pin comprising a cylindrical shaft and a T-slot head style head;

the head can be partitioned such that one portion thereof forms an annular ring while the remaining portion is elongated with a rounded end;

whereby in use, the lower housing utilizes two copies of pin, one of the copies for inserting through bores and the other copy for bores;

the pins are supported in the manner of being 'simply supported' by the ends of the pin in bores and therefor in the left and right sidewalls of the lower housing;

the heads of the pins lock against rotation merely by settling in into the spaced ends of the recessed channel.

It is another aspect of the invention to arrange a roll pin replacement for rifle receivers as follows, comprising in whole or in part, and without limitation:— a pivot axis pin that could serve as a pivot axis pin for a bolt stop release lever; and a lever;

a lower housing having a left sidewall having a front and rear spaced tabs and that are disposed spaced from each other on opposite sides of a slot, and an access channel forward of the front tab;

said pivot axis pin has an elongated cylindrical shank terminating at and transforming into a barrel head formed with external thread;

the rear tab is formed with an accepting bore for the cylindrical end of the cylindrical shaft portion of pin;

the forward tab is formed with a counterpart accepting bore aligned on the same axis as the bore in rear tab, wherein the bore in the forward tab is formed all the way through the forward tab, and, is formed with internal thread in the end of the bore thereof adjacent the access channel;

whereby, in use, the pin is utilized in the manner of being 'simply supported' across the slot and by the spaced tabs;

the pin is aligned in access channel prior to insertion through the accepting bores therefor in tabs and, until the threaded barrel head of the pin engages the threaded portion of the bore in the front tab, and then the pin is then tightened into place.

It is further aspect of the invention to arrange pin arrangements for replacement of conventional roll pins in rifle receivers to comprise in whole or in part, and without limitation:— an elongated pin extending axially between a drive end and tip end, and further comprising an elongated shank portion extending out of an abbreviated head portion to terminate in the tip end;

said shank portion comprises a generally smooth cylindrical sidewall;

said head portion comprises a generally cylindrical sidewall as well except the head portion has a slightly greater diameter, and therefore is slightly enlarged relative the shank portion;

said head portion further being formed with external thread from the drive to the transition into the smaller diameter shank portion end is formed with a socket, slot or like formation(s) for a driving tool to twist the pin;

whereby, in use, the pin is utilized in the manner of being 'simply supported' across a gap by spaced wall portions which have axially aligned bores spaced from each other across the gap, one of which bores is at least a closed ended bore for the pin's tip end, the other an internally threaded throughbore for the pin's externally-threaded head portion; and whereby said pin gets aligned in an access bay outside the insertion-side of the internally threaded throughbore prior to insertion through the accepting bores therefor in the spaced wall portions, until the threaded barrel head of the pin engages the threaded portion of the bore in the wall portion with the internally-threaded bore, and then the pin is then tightened into place.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

FIG. 9 is an enlarged-scale section view taken along line IX-IX in FIG. 3;

DETAILED DESCRIPTION OF THE PREFERRED EMBODIMENTS

Figure 1:
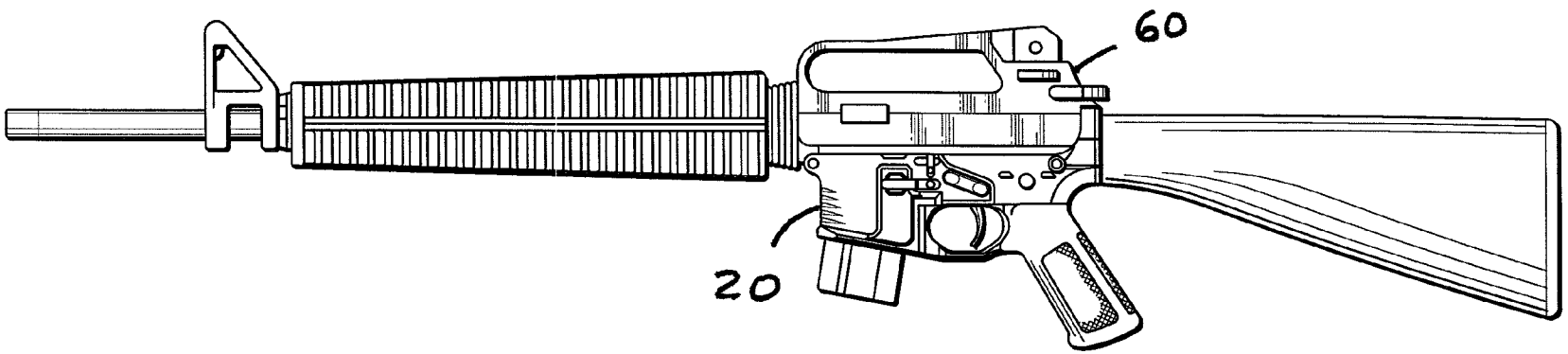
FIG. 1 is a side elevation view of a rifle equipped with a rifle receiver upper and lower housing in accordance with the invention, wherein this view more particularly comprises the port side thereof.
Figure 10:
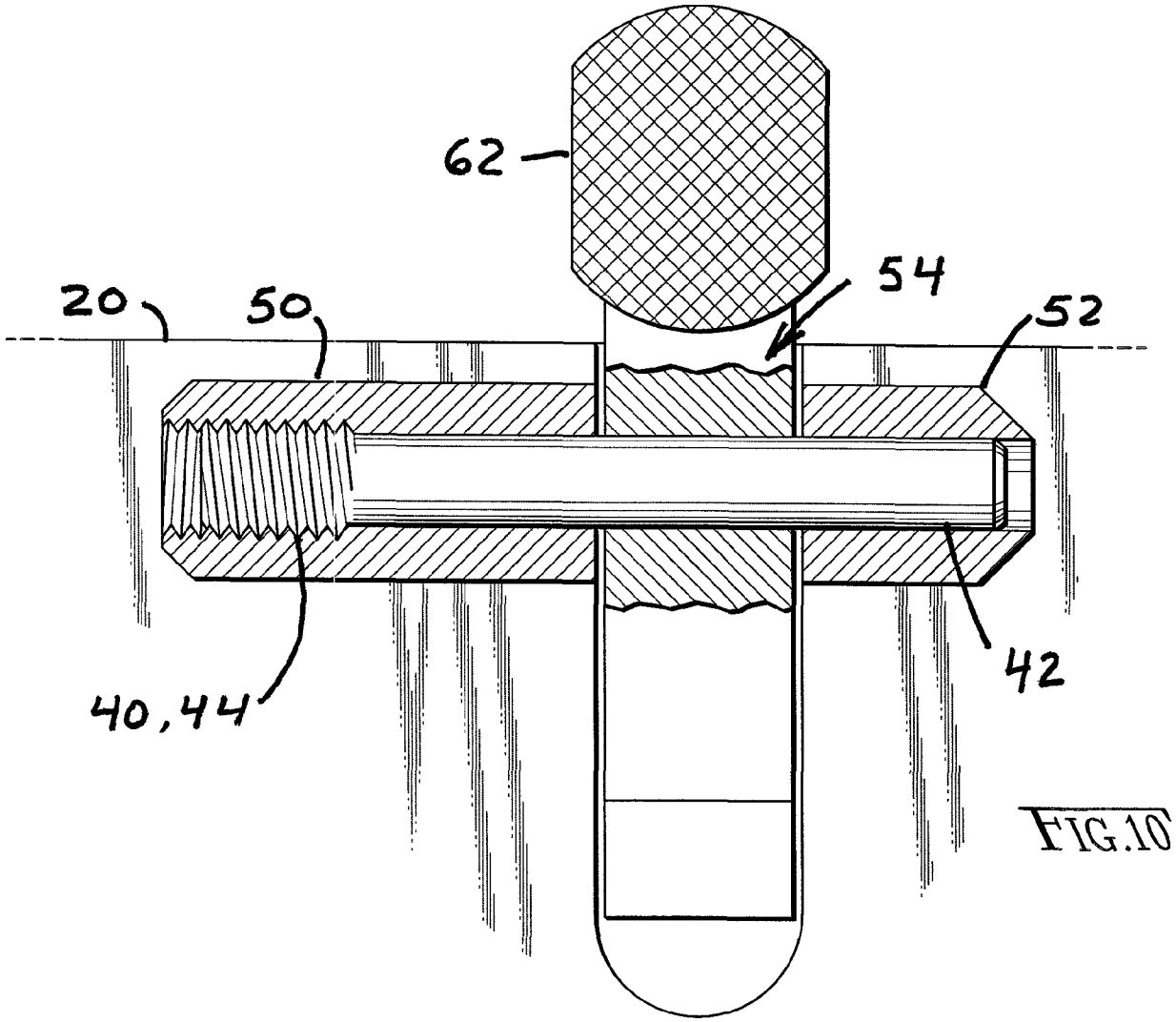
FIG. 10 is an enlarged-scale section view taken along line X-X in FIG. 9.
Figure 11:
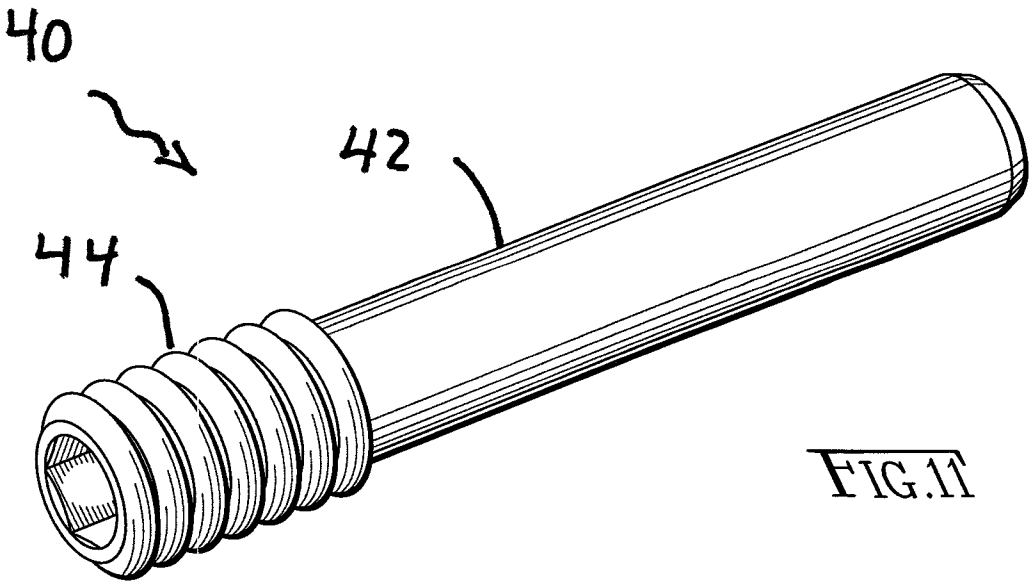
FIG. 11 is a perspective view of a further embodiment of the invention, comprising a threaded assembly pin for a bolt catch (eg., FIG. 10) and/or the socket (eg., FIG. 12) for a forward assist mechanism (not in view) of a rifle receiver.
Figure 12:
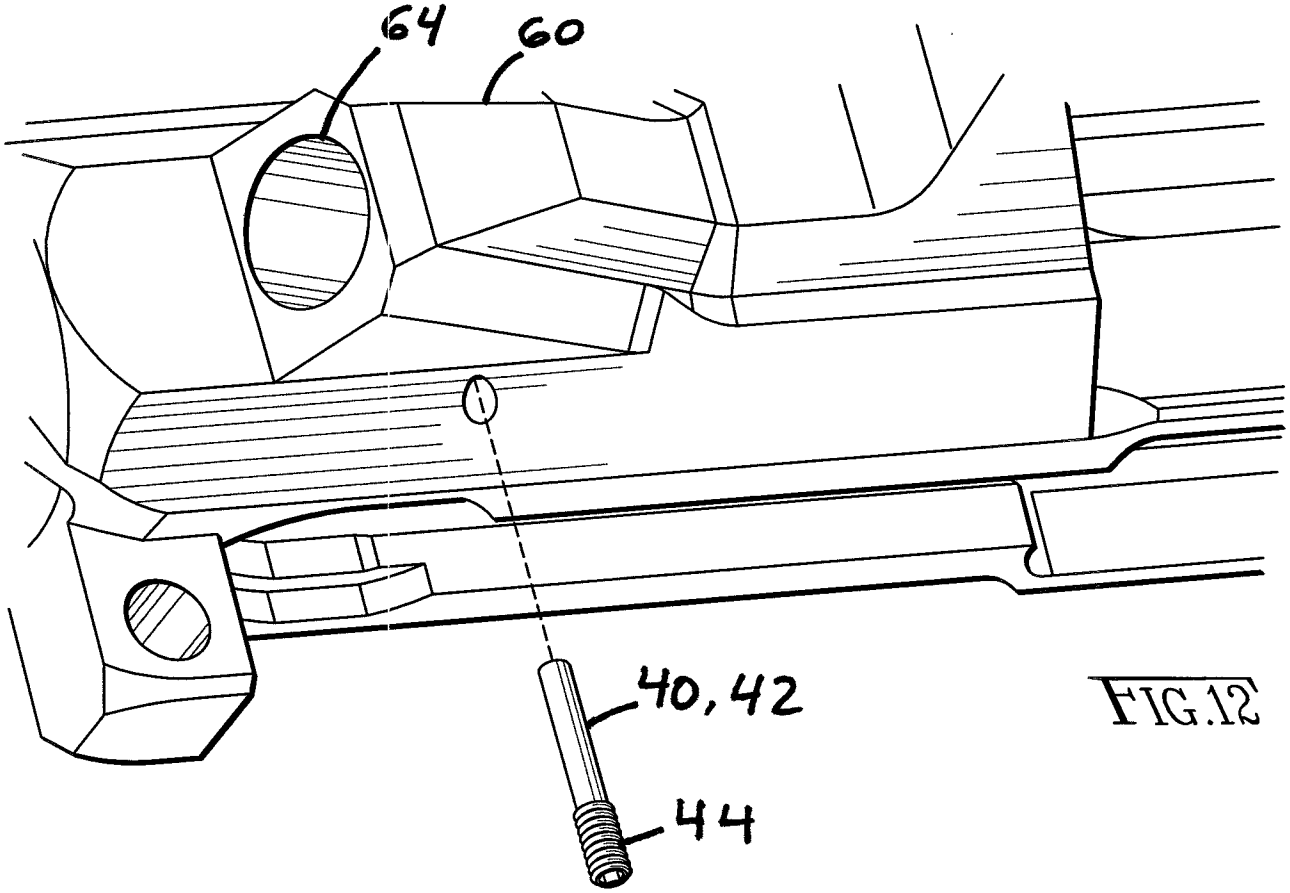
FIG. 12 is a reduced scale perspective view of a rifle receiver upper housing showing insertion for the threaded assembly pin of FIG. 11 for the socket of a forward assist mechanism (not shown).

FIGS. 1-6 and 9-10 show a rifle receiver lower housing 20 in accordance with the invention. FIGS. 1-8 show a first embodiment of a pivot axis pin 30 in accordance with invention for rifle receivers in accordance with the invention such as and without limitation as shown in FIGS. 1-6 and 9-10. FIGS. 10-12 show a second embodiment of a pivot axis pin 40 in accordance with invention for rifle receivers in accordance with the invention such as and without limitation as shown in FIGS. 1 and 12.

FIGS. 2-6 show better a rifle receiver lower housing 20 in accordance with the invention inspired by the objective of improving without limitation the lower housings of AR-15 rifles and like.

The lower housing 20 has a first pair of spaced bores 22 for mounting a pin 30 for mounting a trigger 27. The lower housing 20 has a second pair of spaced bores 24 for mounting a pin 30 for mounting a hammer 28. The lower housing 20 is formed on the outer side of each sidewall thereof with slightly recessed channels 26.

Each recessed channel 26 is elongated between spaced ends. The recessed channels 26 typically run a straight course between the spaced ends, but the spaced ends are rounded. The rounded ends of the recessed channels 26 are preferably centered on the axes of the bores 22 and 24 respectively. These recessed channels 26 might be produced by an end mill milling into outer sidewall of the lower housing 20 on the axis of one bore 22, running a straight course to the axis of the other bore 24, and then withdrawn from any more milling in connection with that pass for the recessed channel 26.

Figure 8:
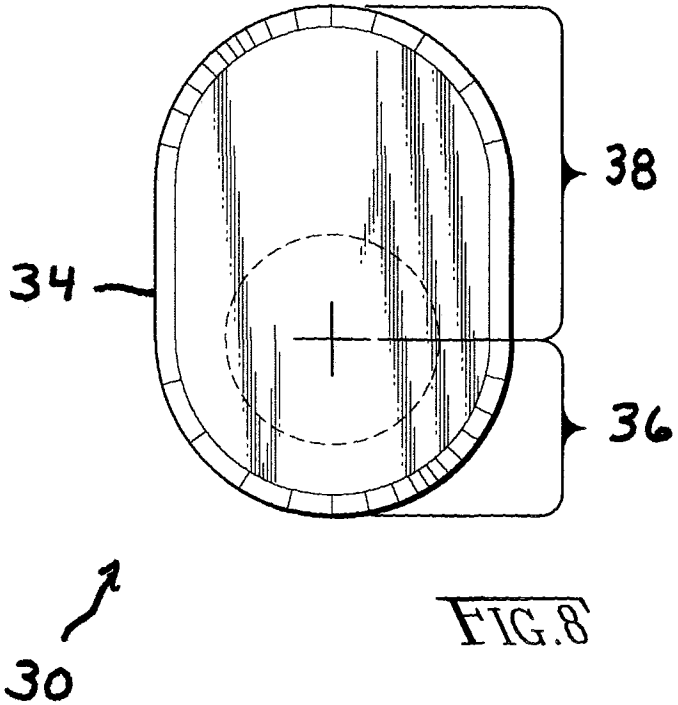
FIG. 8 is an enlarged-scale top-plan view of FIG. 7.
Figure 7:
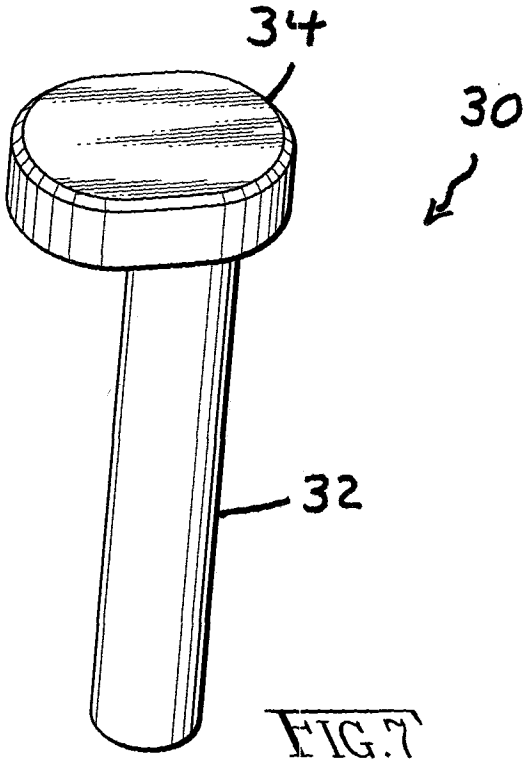
FIG. 7 is a perspective view of a first embodiment of a pivot axis pin in accordance with invention for rifle receivers in accordance with the invention such as and without limitation as shown in FIGS. 1-6.
Figure 6:
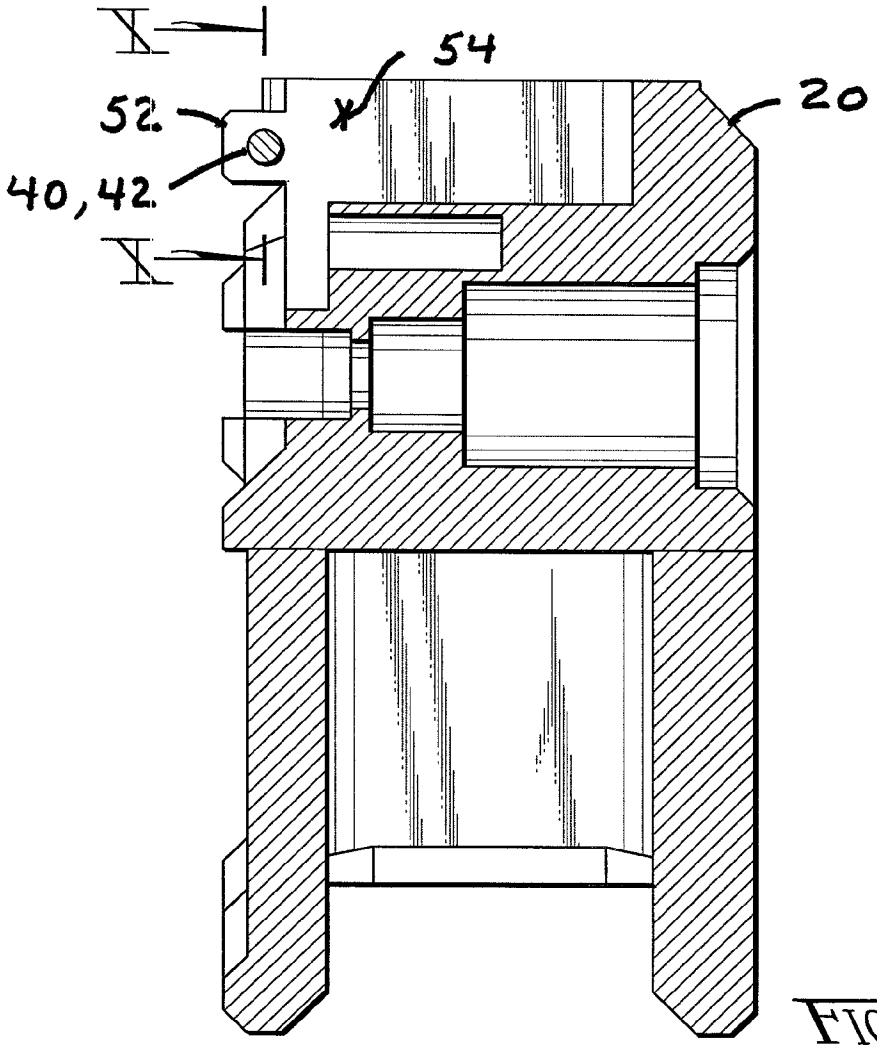

FIGS. 7 and 8 show better a first embodiment of a pivot axis pin 30 in accordance with the invention for rifle receivers such as and without limitation lower housing 20 in accordance with the invention. This pin 30 is designed to serve as the mounting pin 30 for a hammer 28 or trigger 27.

The pin 30 has a cylindrical shank or shaft 32 and a T-slot head style head 34. That is, the head 34 of the of the pin 30 is inspired in part by T-slot head bolts used in machine tool tables.

However, as better shown by FIG. 11, the head 34 can be partitioned such that one portion 36 thereof forms an annular ring while the remaining portion 38 is elongated with a rounded end. In other words, one portion 36 thereof forms a concentric head feature area of the head 34, which is concentric relative to the centerline of the shaft 32. In contrast, the remaining portion 38 comprises an offset head feature area of the head 34, which offset relative to the centerline of the shaft 32.

In use, the lower housing 20 utilizes two copies of pin 30, one of the copies for inserting through bores 22 and the other copy for bores 24. The pins 30 are supported in the manner of being 'simply supported' by the ends of the shaft 32 in bores 22 and 24 therefor in the left and right sidewalls of the lower housing 20. The heads 34 of the pins 30 lock against rotation merely by settling in into the spaced ends of the recessed channel 36. The head 34 of pin 30 for the trigger 27 slips into the trigger area of channel 26 surrounding the bore 22 for the trigger 27, as shown best by FIG. 6. The head 34 of pin 30 for the hammer 28 slips into the counterpart hammer area of channel 26 surrounding the bores 24 for the hammer 28, as shown by any of FIGS. 3-5.

FIG. 11 shows a second embodiment of a pivot axis pin 40 in accordance with invention for rifle receivers such as and without limitation lower housing 20 or upper housing 60 (see, eg., FIG. 12). This pin 40 could serve as for example and without limitation a pivot pin 40 of a bolt catch 62 (see, eg., FIGS. 2 and 10) or as a retaining pin 40 for retention of the forward assist mechanism (not shown) in its socket 64 in the upper housing 60 (see, eg., FIG. 12).

The pin 40 has an elongated cylindrical shank or shaft 42 terminating at, and transforming into, a barrel head 44 formed with external thread.

Attention will be given first to the utilization of the threaded assembly pin 40 in accordance with the invention for mounting of the bolt catch 62.

Figure 2:
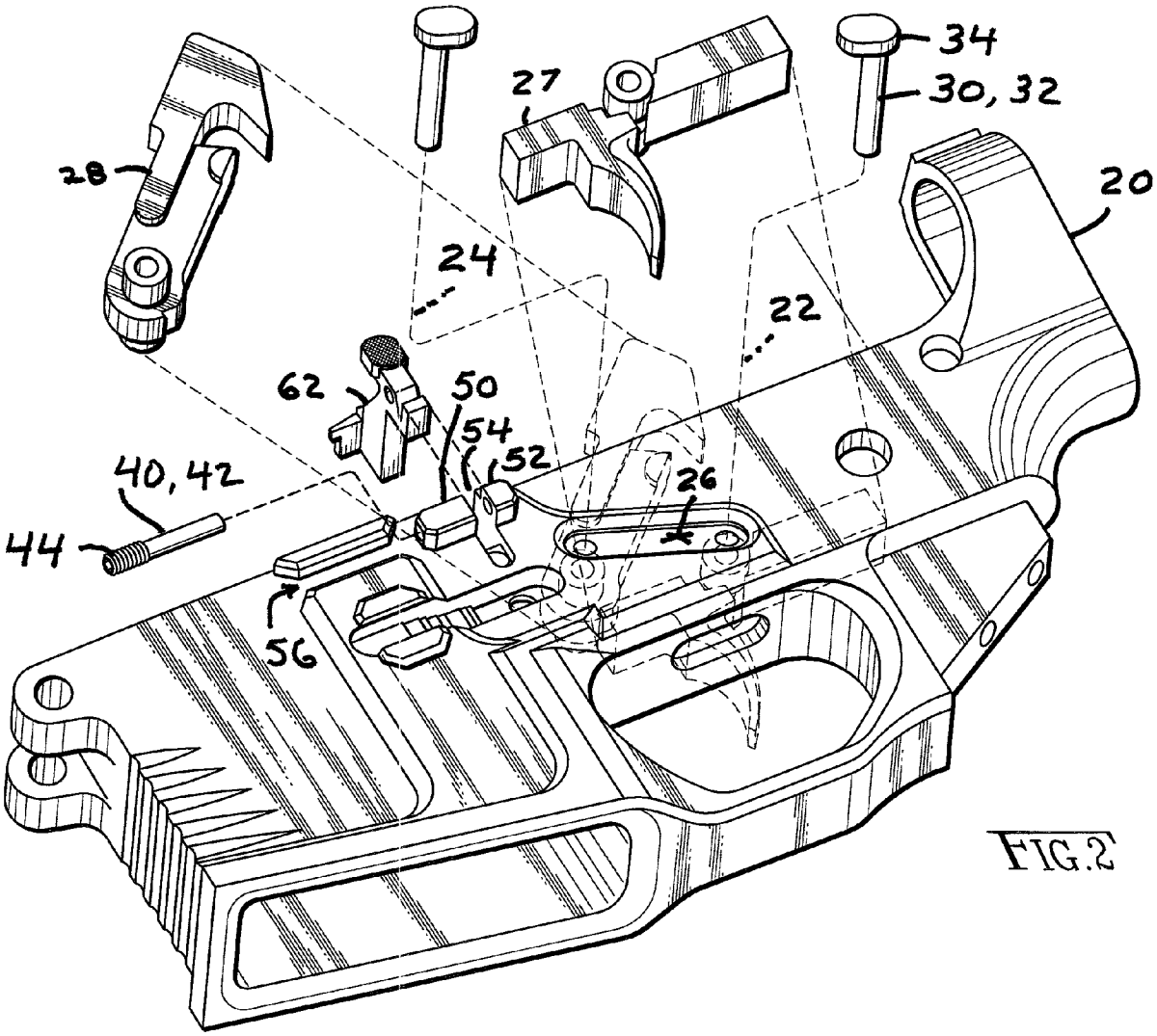
FIG. 2 is an enlarged scale perspective view of the rifle receiver lower housing shown in FIG. 1 in isolation, with selected mechanical components shown exploded.
Figure 3:
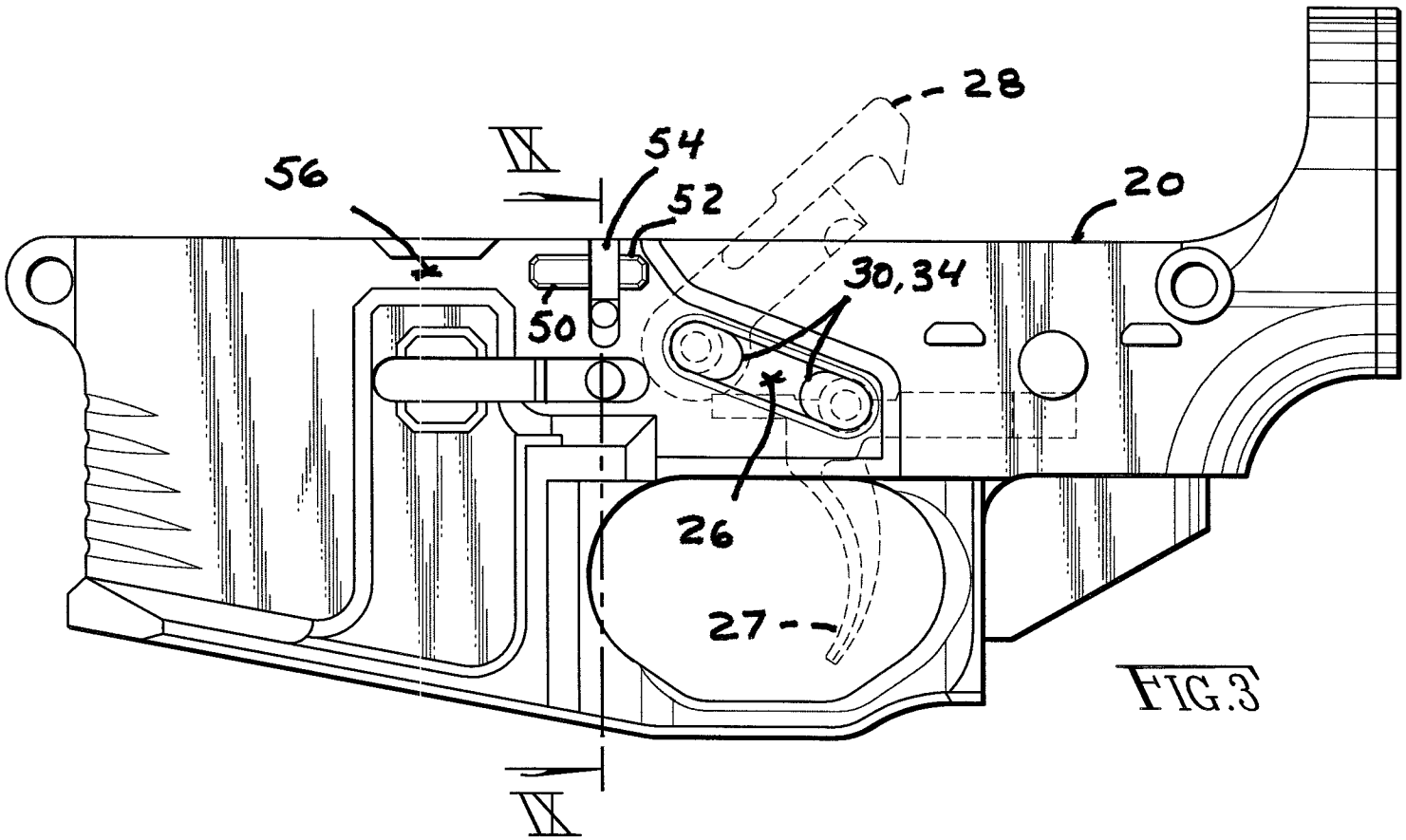
FIG. 3 is a side elevation view of FIG. 2, wherein the trigger and hammer are shown in hidden lines, with the hammer cocked.
Figure 4:
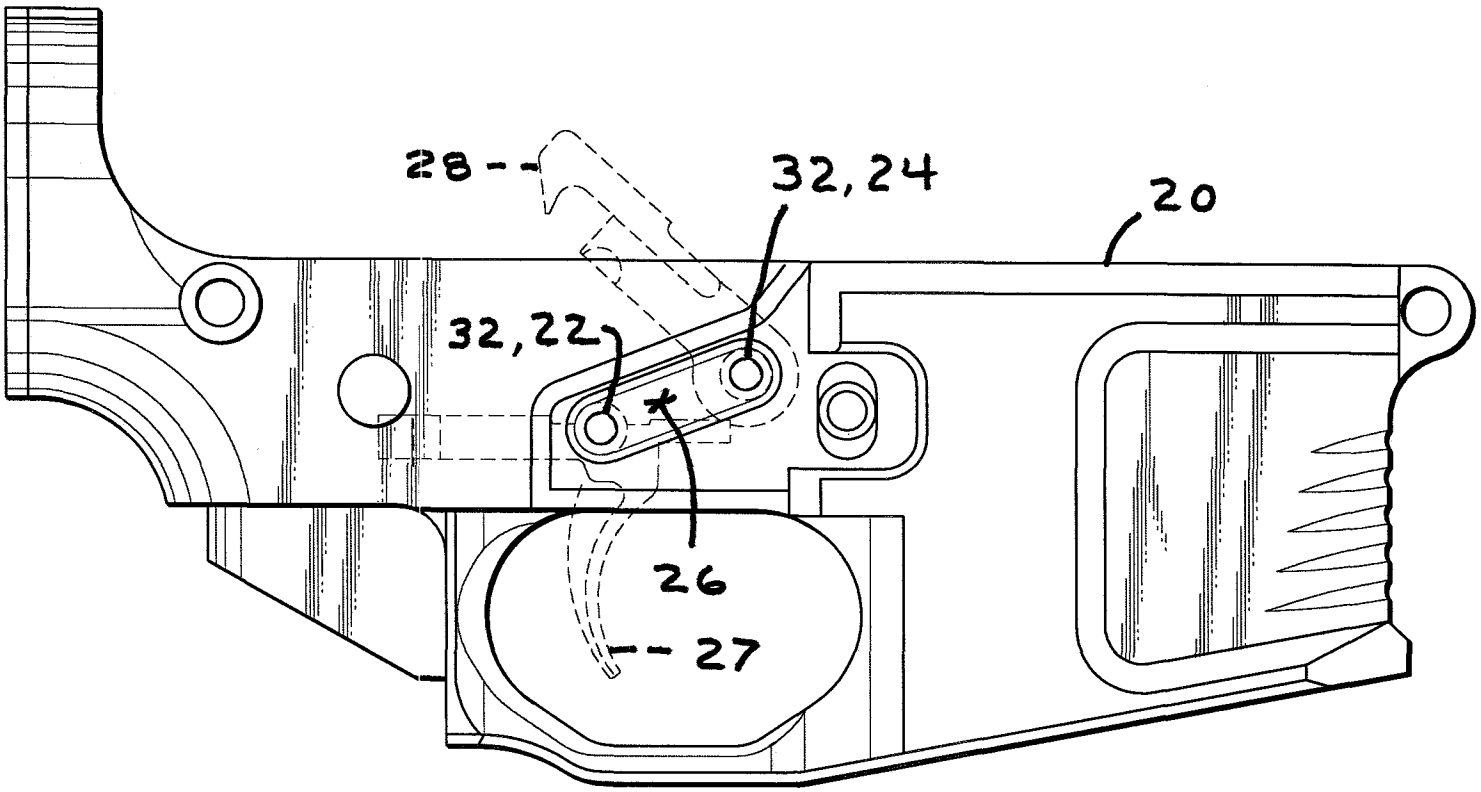
FIG. 4 is a side elevation view comparable to FIG. 3, except from the starboard side thereof.
Figure 5:
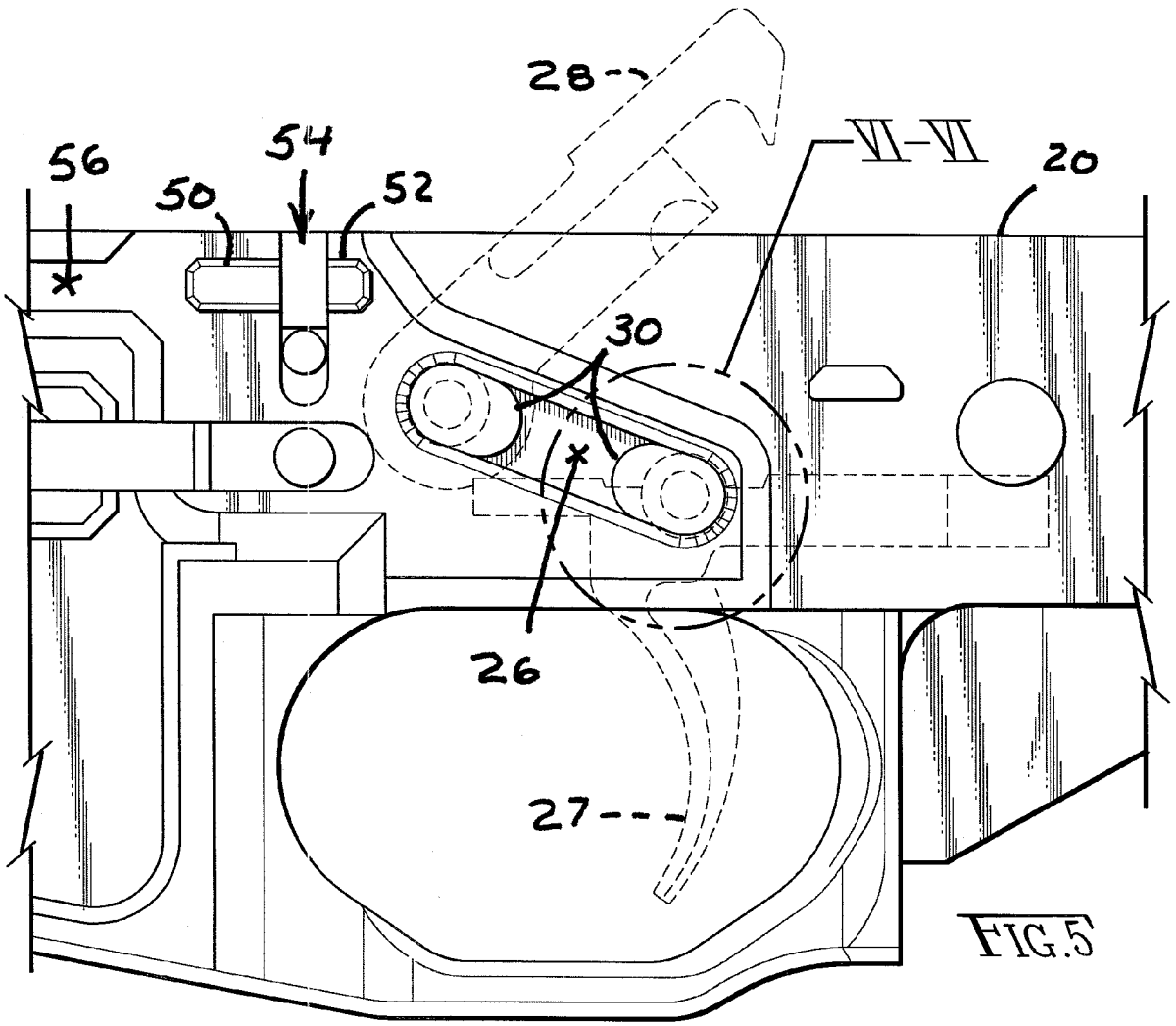
FIG. 5 is an enlarged-scale side-elevation of the central middle of FIG. 3.
Figure 6:
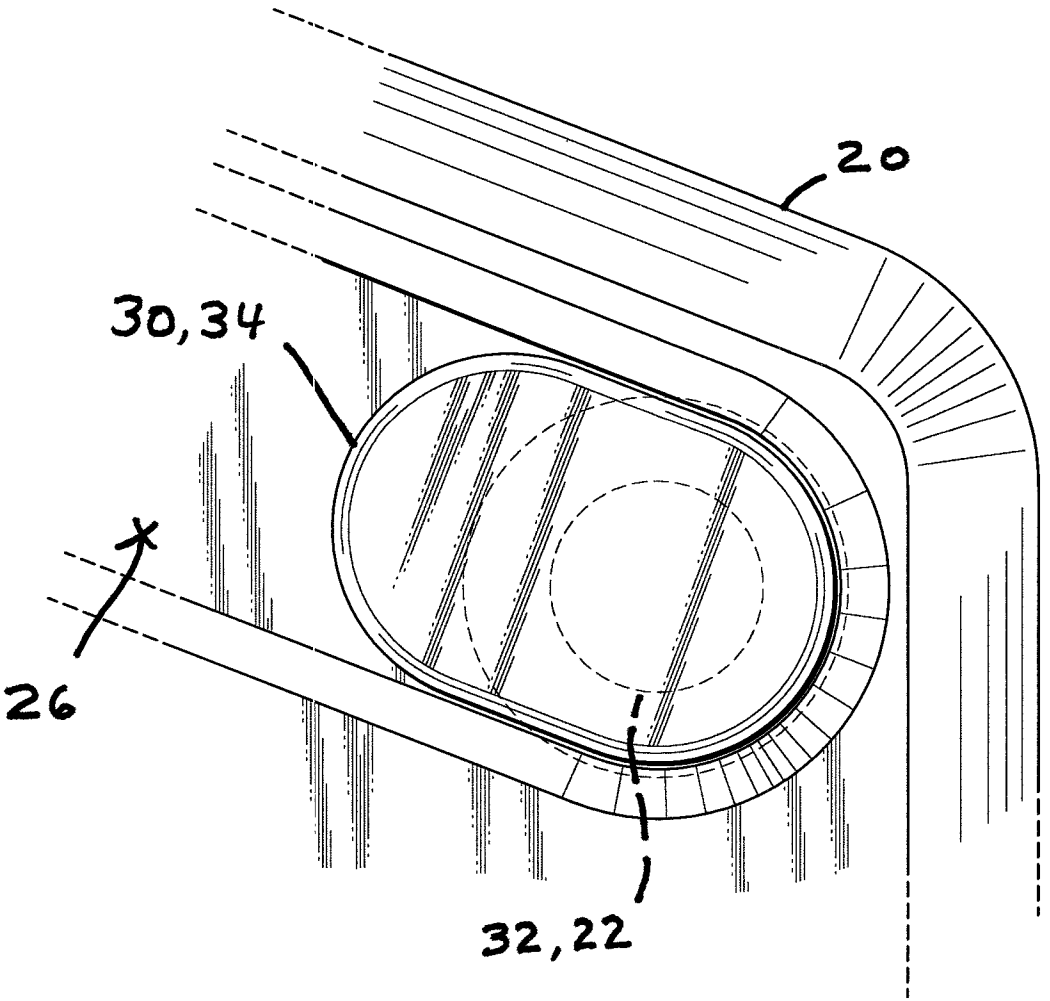
FIG. 6 is an enlarged-scale side-elevation view of detail VI-VI in FIG. 5.

With general reference to FIGS. 2 and 9-10, the lower housing 20's left (port) sidewall has a pair of spaced bosses or tabs 50 and 52 (eg., raised protrusions) that are disposed spaced from each other on opposite sides of a slot 54. The rear tab 52 is semi-conventional but the forward tab 50 comprises an improvement in accordance with the invention for utilization of the pin 40 in accordance with the invention.

The rear tab 52 is formed with an accepting bore for the cylindrical end of the cylindrical shank portion 42 of pin 40, which may or may not pierce all the way through the rear tab 52. The forward tab 50 is relatively more elongated relative to the rear tab 52, perhaps about at least twice as long. Whereas the forward tab 50 is likewise formed with a counterpart accepting bore aligned on the same axis as the bore in rear tab 52, this bore through the forward tab 50 is indeed formed all the way through the forward tab 50. About one-third to one-half of the forward tab 50 (eg., the forward third or half) is formed with internal thread (see FIG. 10) in the end of the bore thereof adjacent an access channel 56 (see, eg., FIGS. 2, 3 and 5) which is another design improvement in accordance with the invention.

In use, the pin 40 is utilized in the manner of being 'simply supported' across the slot 54 and by the spaced tabs 50 and 52. The pin 40 is aligned in access channel 56 prior to insertion through the accepting bores therefor in tabs 50 and 52, until the threaded barrel head 44 of the pin 40 engages the threaded portion of the bore in the forward tab 50 (FIG. 10). The pin 40 is then tightened into place. This is accomplished by a slender and long-shanked hex wrench (not shown) that also utilizes access channel 56. Thread-locking compound can be applied, but only if desired, to hold the threaded barrel head 44 of the pin 40 fast in the internally threaded portions of the forward tab 50 (FIG. 10).

It is an aspect of invention that the trigger and hammer bores 22 and 24 allow for standard hammer and trigger pins (not shown) to still be used. The bores 22 and 24 moreover allow for many aftermarket hammer and trigger pin systems to be used.

The same or comparable considerations apply to the front and rear tabs 50 and 52 too. Standard bolt-stop release-lever pins can still be used therewith, as well as other aftermarket components.

FIG. 12 shows a threaded assembly pin 40 in accordance with the invention for insertion transverse through a portion of a cylindrical socket 64 in the upper housing 60 for retention of a forward assist mechanism (not shown) of an AR-15 firearm. FIG. 12 shows the threaded assembly pin 40 in accordance with the invention hovering below the place of insertion for it in the AR-15 upper housing 60.

It is an aspect of the invention to replace the use of prior art roll pins with an inventive threaded assembly pin 40 according to FIGS. 10 and 12. The inventive assembly pin 40 extends axially between a head 44 and a tip end of shank 42. The head 44 is relatively abbreviated head portion 44 relative the elongated shank 42. The shank 42 comprises a generally smooth cylindrical sidewall. The head 44 is generally cylindrical as well except the head portion 44 has a slightly greater diameter, and therefore is slightly enlarged relative the shank 42. Furthermore, the head 44 is formed with external thread. The head 44 is also formed with a socket, slot or like formation(s) for a drive tool to twist the pin 40. A hex socket is preferred without limitation.

Given the foregoing, the relatively smooth shaft 42 will enable the inventive assembly pin 40 according to FIG. 12 still perform the ability to position and lock the standard forward assist mechanism (not shown) in place. Whereas, the threaded head 44 of the inventive assembly pin 40 will secure this threaded assembly pin 40 in place. It is a further aspect of the invention that this inventive assembly pin 40 also allows for easier dis-assembly of the forward assist mechanism (not shown) for cleaning or replacement.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A pivot axis pin arrangement for mounting a trigger and a hammer on a rifle receiver, comprising: a trigger; a hammer; a pair of pivot axis pins, one comprising a trigger pin that mounts the trigger on the rifle receiver and the other comprising a hammer pin that mounts the hammer on the rifle receiver; and a lower housing of the rifle receiver having a left sidewall and a right sidewall laterally spaced from each other so as to define a longitudinal cavity that provides clearance for the mounting of a trigger; said lower housing of the rifle receiver having a first pair of lateral bores laterally-spaced across the longitudinal cavity for mounting the trigger with the trigger pin on the lower housing of the rifle receiver; said lower housing of the rifle receiver having a second pair of lateral bores laterally-spaced across the longitudinal cavity of the rifle receiver for mounting a hammer with the hammer pin; said left and right sidewalls of the lower housing of the rifle receiver each having a recessed channel located on an outer side of the left and right sidewalls of the lower housing of the rifle receiver with both of said recessed channels having rounded ends centered on the axes of the first pair of spaced bores and the second pair of spaced bores wherein the rounded ends are separated by an elongated space within each channel of the lower housing of the rifle receiver; each pivot axis pin comprising a cylindrical shaft and a T-slot head; wherein each head is partitioned between one portion and a remaining portion such that the one portion thereof forms an annular ring while the remaining portion is elongated with a rounded end; wherein said trigger pin is extended through the first pair of lateral bores on the lower housing of the rifle receiver such that the head of the trigger pin settles into one of the recessed channels and the shaft of the trigger pin is simply supported at spaced apart locations by the extension of the trigger pin's shaft through the first pair of lateral bores: wherein said hammer pin is extended through the second pair of lateral bores such that the head of the hammer pin settles into one of the recessed channels and the shaft of the hammer pin is simply supported at spaced apart locations by the extension of the hammer pin's shaft through the second pair of lateral bores; and wherein the heads of the trigger pin and hammer pin respectively lock against rotation by settling into the spaced ends of one of the recessed channels.

2. A pivot axis pin arrangement for mounting a trigger and a hammer on a rifle receiver, comprising: a trigger; a hammer; a pair of pivot axis pins, one comprising a trigger pin that mounts the trigger on the rifle receiver and the other comprising a hammer pin that mounts the hammer on the rifle receiver; and a lower housing of the rifle receiver having a left sidewall and a right sidewall laterally spaced from each other so as to define a longitudinal cavity that provides clearance for the mounting of a trigger; said lower housing of the rifle receiver having a first pair of lateral bores laterally-spaced across the longitudinal cavity for mounting the trigger with the trigger pin; said lower housing of the rifle receiver having a second pair of lateral bores laterally-spaced across the longitudinal cavity for mounting the hammer with the hammer pin; said left and right sidewalls of the lower housing of the rifle receiver having outer sides, at least one outer side of either the left or right sidewall of the lower housing of the rifle receiver in connection with the first lateral bore is formed with a surrounding recess having at least one offset recess feature, and at least one outer side of either the left or right sidewall in connection with the second lateral bore is formed with a surrounding recess having at least one offset recess feature; wherein each pivot axis pin comprises a cylindrical shaft and an enlarged head provided with an offset head feature that corresponds with the respective offset recess feature in respect of the respective recess surrounding the respective bore for the respective pivot axis pin; wherein said trigger pin is extended through the first pair of lateral bores such that the head of the trigger pin settles into the surrounding recess in connection with the first pair of lateral bores in the outer side of either the first or second sidewall of the lower housing of the rifle receiver and the shaft of the trigger pin is simply supported at spaced apart locations by the extension of the trigger pin's shaft through the first pair of lateral bores; wherein said hammer pin is extended through the second pair of lateral bores such that the head of the hammer pin settles into the surrounding recess in connection with the second pair of lateral bores in the outer side of either the first or second sidewall and the shaft of the hammer pin is simply supported at spaced apart locations by the extension of the hammer pin's shaft through the second pair of lateral bores of the lower housing of the rifle receiver: and wherein the heads of the pins lock against rotation by the respective offset head feature therefor settling into the respective offset recess feature therefor.

* * * * *